US005351423A

United States Patent [19]

Vohl

[11] Patent Number: 5,351,423

[45] Date of Patent: Oct. 4, 1994

[54] BALL AND SOCKET JOINT FOR SNOWBLOWER CHUTE CONTROL ROD LINKAGES

[76] Inventor: Raynald Vohl, 411 Saint-Gilbert Street, St-Marc-des-Carrières, Canada, G0A 4B0

[21] Appl. No.: 5,095

[22] Filed: Jan. 15, 1993

[51] Int. Cl.[5] ..... E01H 5/09

[52] U.S. Cl. ..... 37/260; 403/134

[58] Field of Search ..... 37/260, 261, 244, 259; 403/122, 134, 135, 140, 141, 167

[56] References Cited

U.S. PATENT DOCUMENTS

| | | | |
|---|---|---|---|
| 3,075,813 | 1/1963 | Vohl | 37/260 X |
| 3,483,960 | 12/1969 | Wightman et al. | 37/260 X |
| 3,552,045 | 1/1971 | Fieber | 37/260 |
| 3,808,715 | 5/1974 | Haban | 37/260 |
| 4,312,143 | 1/1982 | Kado | 37/261 |
| 4,549,365 | 10/1985 | Johnson | 37/260 X |
| 4,862,607 | 9/1989 | Wacker | 37/260 |
| 5,100,254 | 3/1992 | Wasada | 403/134 |
| 5,114,261 | 5/1992 | Sugimoto et al. | 403/122 |
| 5,209,596 | 5/1993 | Matczak et al. | 403/134 |

*Primary Examiner*—Randolph A. Reese
*Assistant Examiner*—Spencer Warnick
*Attorney, Agent, or Firm*—Pierre Lespérance; Francois Martineau

[57] ABSTRACT

The snow discharge spout pipe from a snowblower is conventionally extended by spout extensions commanded by control rod linkages. The present ball and socket joints are used to interconnect each pair of successive link arms to one another, and some link arms to the snowblower casing. These joints are of the universal joint type, including a ball rotatable into a spherical socket. Each end of a link arm has such a joint. Each socket is composed of two ring members in mutual contact at their flat inner radial faces. These faces are precisely machined to obtain the desired clearance between the spherical surfaces of the ball and ring members. Each ball includes an axial bore, rotatably receiving a shoulder bolt. The bolt and ball have lubricating passages opening at the relatively movable bearing surfaces of the bolt, ball and ring members.

4 Claims, 2 Drawing Sheets

BALL AND SOCKET JOINT FOR SNOWBLOWER CHUTE CONTROL ROD LINKAGES

FIELD OF THE INVENTION

This invention relates to universal joints for control rod linkages, particularly for use in commanding the snow discharge spout pipe extensions of snowblowers.

BACKGROUND OF THE INVENTION

U.S. Pat. No. 3,075,813 issued Jan. 29, 1963 to Adrien VOHL—being the father of the present inventor—discloses a control rod linkage assembly for assisting in the extension or retraction of telescopic sections carried at the outer free end of the snow discharge pipe spout of a snowblower truck. The control rod linkage assembly consists of a number of pivotally interconnected link bars, extending from the base of the main snow discharge spout up to the telescopic parts at the outer end of the main discharge spout. By pivoting the lower link bar, the intermediate link bars are biased to urge the upper link bars to pivot the telescopic spout extensions accordingly.

One drawback of this otherwise efficient patented system, is that, under rough conditions where the snow discharge chute becomes damaged and bent, the control rod linkage assembly progressively becomes more difficult to operate. The reason for this is that, as the snow discharge chute becomes bent following abuse, the pivotal axes of some of the pivotal joints interconnecting the various link arms of the control rod linkage assembly will tilt. Because a simple axial pin is mounted at the pivot joints, this tilting of the link arms means that the axial pins thereof will become offset from their pivotal axles.

U.S. Pat. No. 3,516,713 issued in 1970 to Wagstaff, addresses this problem by providing a universal joint that operates the chute of a forage harvester. Another example of such universal joints for control rod linkages is disclosed in Canadian patent No. 423,567 issued Oct. 31, 1944—here a ball and socket joint. In this latter patent, the joint has an oilless bearing material surface riding in a metal socket.

OBJECTS OF THE INVENTION

The general object of the present invention is to improve upon the above-noted U.S. Pat. No. 3,075,813 by replacing the pin-type pivot joints of the snow spout pipe control linkages by ball and socket joints.

More particularly, the prime object of the invention is to provide a ball and socket joint wherein the proper clearance at the interface defined between the spherical surfaces of the socket and of the ball is obtained in a simple manner.

SUMMARY OF THE INVENTION

According to the invention, there is disclosed a ball and socket joint at the ends of control rod linkages. In a specific application, said control rod linkages command extension/retraction of telescopic outer end extensions of a snow discharge pipe from an automotive snowblower truck. The combination of the invention comprises: a link rod with a ball and socket joint, said link rod having a flat end collar with opposed parallel, flat, collar faces and a through bore surrounded by said collar faces, a pair of similar seating rings having partially spherical seating surfaces, said rings together defining a ball socket, each seating ring including a cylindrical body having a transverse, flat, body inner face at its inner end and an out-turned shoulder at its outer end, said shoulder having a flat, annular, shoulder inner face parallel to said body inner face, said cylindrical bodies inserted into said through bore through opposite ends thereof with said body inner faces in direct flat contact and with said shoulder inner faces overlying the respective collar faces with a small clearance, securing means to secure said seating rings to said collar, a ball retained in said socket, said ball having a through bore and a shank extending through said through bore, the interface clearance between said ball and said socket allowing free relative rotatable movement of said ball within said socket but without play.

Preferably, said seating rings are welded to said collar at said collar faces, said weld constituting said securing means.

Preferably, said ball has opposite ball flat faces surrounding and normal to said through bore and wherein said shank is a shoulder bolt with a head abutting against one of said ball faces, a bearing part surrounded by said ball and a threaded part protruding from said ball at the other one of said ball faces, and a nut screwed on said threaded part and engaging said other one of said ball faces.

Preferably, a marker protrudes from said head away from said bearing part to produce a positioning indentation on a metal surface against which said shank is hammered.

Preferably, there is provided a lubricating system including intercommunicating lubricating passages opening at the free end of said threaded part, extending through said shank and ball, and opening at the interface between said ball and socket.

DETAILED DESCRIPTION OF THE INVENTION

Figure 1:
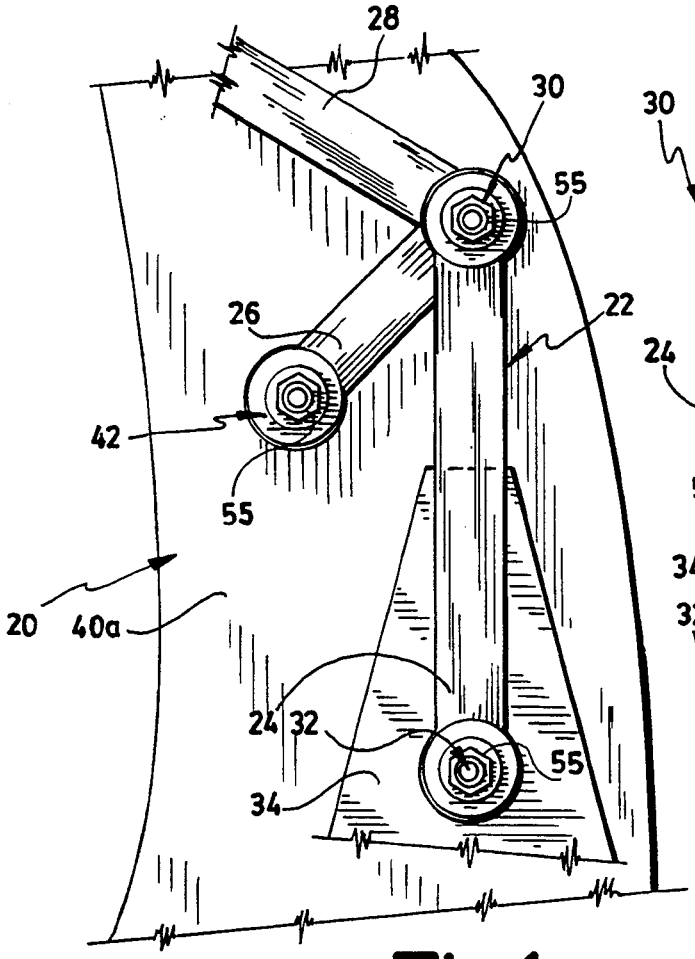
FIG. 1 is a fragmentary elevation of the base of the snow discharge spout pipe from a snow blower truck, showing in plan view the lower set of control rod linkages that control the angular curvature of the spout.

In FIG. 1, there is shown the lower part of a conventional snow discharge spout pipe 20, forming part of a motor engine snow blower truck (not shown). This spout pipe lower part 20 is generally vertical, and is directly secured to and in communication with the interior of a snow receiving, ground skimming, open casing (not shown), usually mounted ahead of the snow truck. This snow casing includes the standard, transverse, high speed rotating worm screw, which collects and crushes ground packed snow and ejects same under centrifugal force through a snow outlet in the casing in open register with the bottom inner end of spout pipe 20.

The spout pipe 20 is elongated and curved away from its generally vertical base portion, so as to be able to discharge at a distance from the snow blower truck (e.g. over the bed of a proximate snow transport truck) the ground snow collected by the front loaded casing of the snow blower truck. The spout pipe 20 carries at its upper outer end a number of hingedly mounted telescopic spout pipe extensions (not shown), which will extend theoverall radius of curvature of the spout pipe to provide improved control as to the total lateral distance from the snow blower truck the snow can be ejected.

These telescopic spout pipe extensions are e.g. of the type illustrated in U.S. Pat. No. 3,075,813 issued in 1963 to the father of the present inventor.

Figure 2:
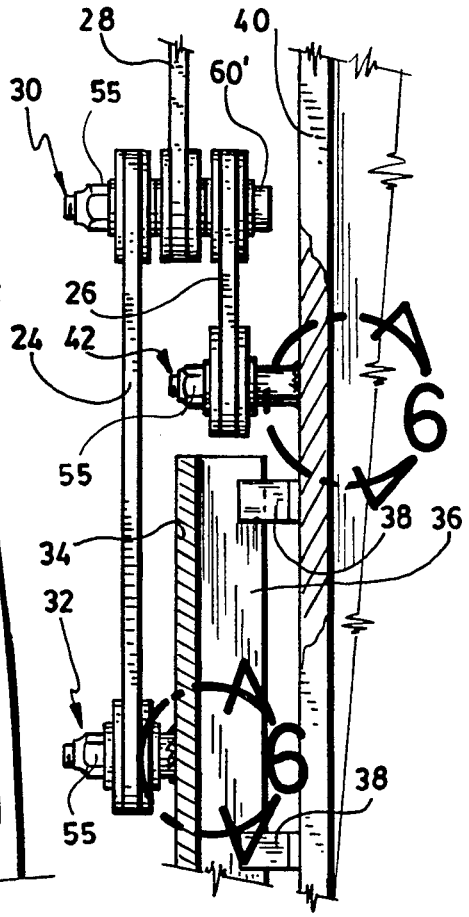
FIG. 2 is a partly sectional elevation of the spout pipe and control linkages, from a perspective at right angle relative to that of FIG. 1.

According to the invention, the telescopic spout pipe extensions are pivotable about a pitch axis relative to the spout pipe proper 20, by control rod linkages 22, only the lower portion of which is illustrated in FIGS. 1-2. This lower portion of the control rod linkages 22 includes a lowermost, elongated, lead lever 24, an upper, shorter lever 26, and a link bar 28 pivotally interconnected at first pivot means 30 to both levers 24 and 26. The lower end of lead lever 24 is pivotally interconnected at second pivot means 32 to a triangular plate 34. Plate 34 is provided with a vertical rail 36 slidingly mounted into the grooves of guide blocks 38, the latter being anchored to the flat wall 40 of the lower portion of cross-sectionally quadrangular spout pipe 20, in vertically spaced fashion. Plate 34 is vertically movable relative to spout pipe 20, in the same way as disclosed in aforementioned U.S. Pat. No. 3,075,813. Short lever 26 is pivotally mounted to spout pipe flat wall 40, about third pivot means 42. Pivot means 42 is located above pivot means 32, and, relative to the radius of curvature of spout pipe 20, is further located inwardly of a vertical plane orthogonally intersecting the spout pipe flat wall 40 at the location of pivot means 32.

The pivotal axes of pivot means 30, 32, 42, remain parallel to one another, as well as orthogonal to the same one flat wall 40 from the four side walls of the cross-sectionally quadrangular snow chute 20, at the pivotal engagement loci of pivot means 30, 32, 42.

Figure 3:
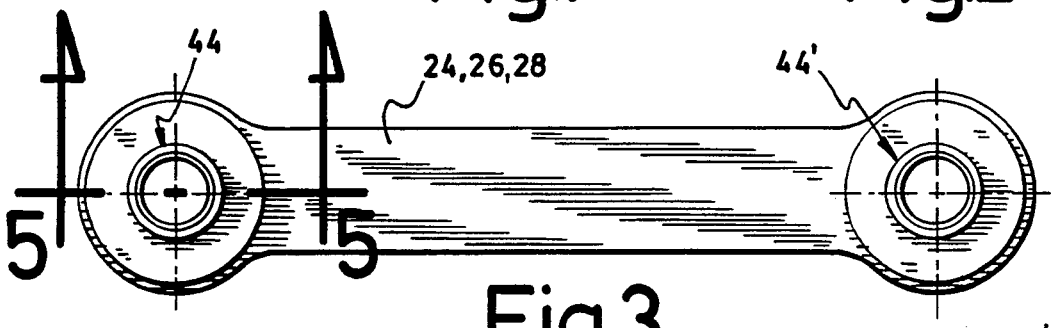
FIGS. 3 and 4 are a plan view and an edge view, respectively, of the lowermost lead rod from the control rod linkages of FIG. 1.
Figure 4:
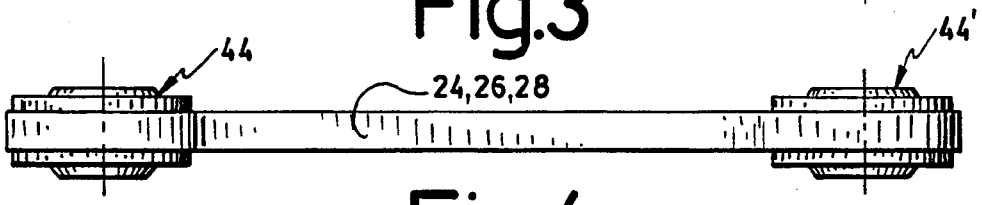

As illustrated in FIGS. 3-4, each elongated lever 24, 26, and link 28 includes a pair of socket joints 44, 44', at opposite ends thereof. Each joint 44 or 44' pivotally carries a corresponding pivot means 30, 32, 42.

Figure 5:
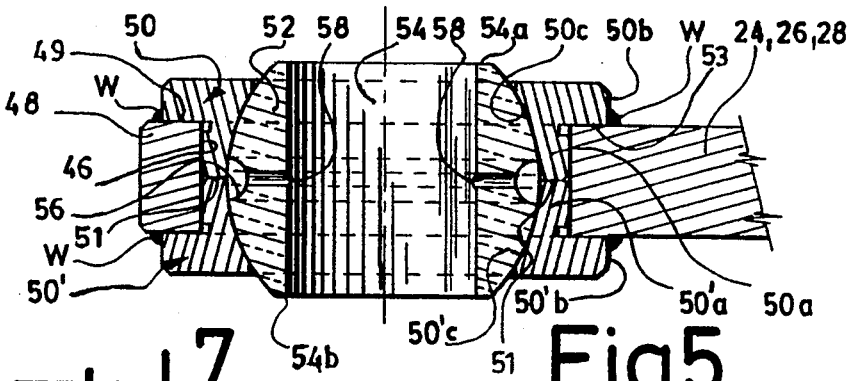
FIG. 5 is a cross section at an enlarged scale along lines 5—5 of FIG. 3.

A socket joint 44, illustrated in FIG. 5, is mounted in a collar 48 having opposite flat faces 49 surrounding a large circular bore 46. Collars 48 are integrally formed, one at each end of levers 24, 26, 28. Socket joint 44 includes a pair of complementary, similar seating rings 50, 50', which are fitted inside each bore 46 in opposite relation. Each ring 50 (50') defines a diametrally smaller cylindrical body part **50*a*, snugly engaging a fraction of the bore 46 of collar 48, and a diametrally larger shoulder part 50*b*, snugly overlapping most of the faces 49 of collar 48. The two rings have at their inner axial end a precisely machined inner radial face 51, both faces 51 being in mutual contact. When the two rings are thus in mutual contact, their radial shoulder face 53 makes a small clearance with the registering face 49 of collar 48. The two rings shoulder parts 50*b*, 50'*b*, are welded at their radially outermost edge, W, to the collar 48. Each ring 50 (50') further defines a radially inner, segmental, spherical, seating surface 50*c* (50'*c*), whereby both surfaces 50*c*, (50'*c*) form a spherical seat for a spherical ball. A rigid (preferably metallic) spherical ball 52 is seated in the seating rings 50 on the segmental spherical surfaces thereof 50*c*. The required precise clearance between the seating faces 50*c*, 50'*c* of rings 50, 50' and ball 52 is automatically obtained when faces 51 are in contact. A ball and socket joint 44, 44', is thus obtained, i.e. the ball 52 is freely rotatable and tiltable into the socket defined by the two seating rings 50, 50'**, yet without play.

The metal ball 52 has a cylindrical axial bore 54, extending centrally through ball 52 and opening at opposite parallel flat faces **54*a*, 54*b* of ball 52. The radially outward face of ball 52 is grooved at an intermediate section thereof to form a peripheral annular groove 56. Annular groove 56 communicates with bore 54 through a few small radial passages 58, made in spheroid ball 52. Annular groove 56 is in turn in direct communication with the internal seating surfaces 50*c*, 50'*c*, of rings 50, 50'**.

Lubricating fluid is to be fed into the ball through bore 54, and then through radial channels 58 into the annular groove 56 at the periphery of ball 52. As spherical ball 52 is rotated, the lubricating fluid in groove 56 will spread over the interior surfaces **50*c*, 50'*c* of the seating rings 50, 50', with which it will eventually come in contact. This will allow continuous lubrication of the ball and socket joint 44, 44' as the levers 24-28 are pivoted during actuation of the control rod linkage 22, since the ball 52 will be able to both rotate and tilt in all planes relative to the collar 48**.

An elongated pivot shank or shoulder bolt 60 (FIG. 8) is engaged through axial bore 54 of metal ball 52. Shank 60 includes an intermediate, enlarged, cylindrical bearing part 62, snugly engaged into the hollow ball axial bore 54, while threaded part 64 and head part 66 of shank 60 project outwardly from spherical ball 52 on opposite sides thereof. An axial channel 68 opens at the end of threaded part 64 and into at least one (and preferably a few) radial channel(s) 70, made within bearing part 52. Radial channel 70 in turn opens into an annular groove 72 made on the radially outer surface of bearing cylindrical part 62. Groove 72 of shank 60 is to come in continuous register with the fluid intake port (the radially inner mouth of radial channel 58) of metal ball 52.

Axial channel 68 outwardly opens within an enlarged mouth **64*a*. A lubricating fluid valve 74 is threadingly fitted into the enlarged mouth. Valve 74 may be of the type known under the trade name ZERK. Valve 74 is periodically fed manually with lubricating fluid, to incrementally fill up the lubricating fluid inside axial channel 68 and radial channel 70. Channels 58, 68, 70, and annular grooves, 56, 72,—which are in communication with one another—in turn constitute a reservoir of lubricating fluid, wherein continuous feeding of the latter to the interface between ball 52 and socket 50, 50'**, can be achieved during joint rotation.

The external surface diameter of the shank intermediate bearing part 62 should be substantially equal to the diameter of the spherical ball axial bore 54, so that shank part 62 engages with a friction fit. Head part 66 is tightened against one flat face **54*a* or 54*b* of ball 52 by a self-locking nut 55, screwed on bolt threaded part 64, and abutting against the other flat face 54*b* or 54*a***.

Diametrally largest head part 66 of shank 60 is to abut flatly against the exterior lateral side surface of wall 40 of snow chute 20, and to be welded in position by weld means W.

Figure 6:
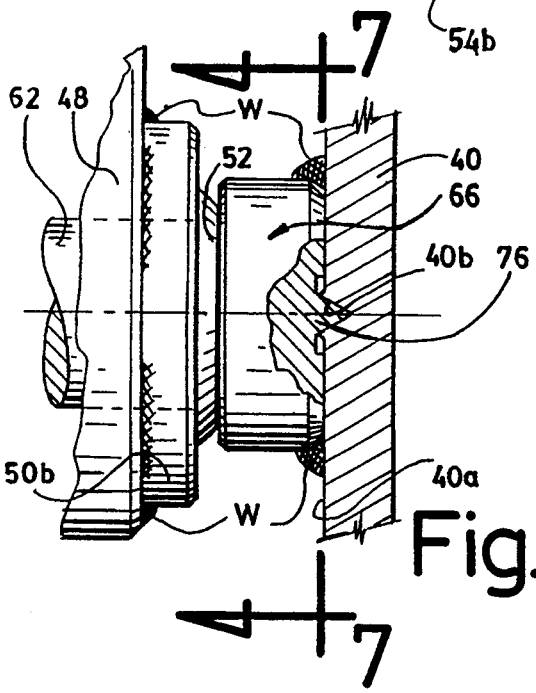
FIG. 6 is an enlarged view of the area circumscribed within either one of circles 6 from FIG. 2, showing a first embodiment of pivotal shank that pivotally mount the control rod linkage to the snow discharge spout pipe.
Figure 7:
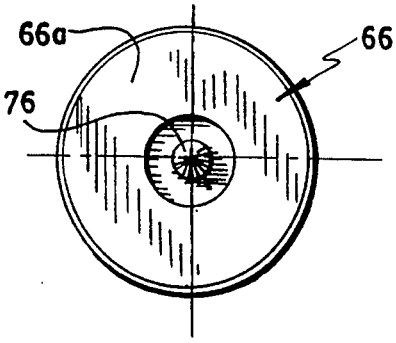
FIG. 7 is a cross-section about line 7—7 of FIG. 6.

According to an important feature of the invention, the flat outer free surface 66*a* of head part 66 axially carries a sharp, conical marker tip 76, projecting outwardly from the plane of surface 66*a* orthogonally thereof. Marker tip 76, which is made of hardened steel as is shoulder bolt 60, is to be driven into the outer surface 40*a* of the snowblower casing wall 40, thus defining a V-shape cavity 40*b*, through a fraction of the thickness of metal casing 40, as suggested in FIG. 6, to therefore precisely position shank 60 during welding to casing 40 by weld means W. Hammer blows are applied axially against the free end of the shank opposite end part 64, with the ZERK valve 74 being previously removed.

Marker tip 76 is advantageous during installation of the control rod linkages 22 to the snow blower chute 20, since it enables precise spatial positioning of the pivot means 42 relative to the casing wall 40, as well as corresponding precise spatial positioning of the pivot means 32 on the triangular plate 34. Marker tip 76 is especially useful when restoration work is effected on a used snow blower chute wherein the old pivot pins welded to the casing walls 40 are cut off and the shoulder bolts 60 welded to walls 40 at the old pivot pin positions.

It is understood from FIG. 2 that pivot means 30 consists of a single shank 60' which is free of casing 40, and which extends through three sets of ball and socket joints 50, 52, at the corresponding transversely registering ends of link bars 24, 26, 28. The shank 60 of pivot means 42 is anchored directly to casing wall 40, clearing the top edge of triangular plate 34 but in spaced substantially overlying register. The shank 60 of pivot means 32 is also secured to casing 40 (albeit indirectly, through elements 34, 36, 38,) and is outwardly offset from said casing wall 40 relative to the vertical plane intersecting said pivot means 42.

Hence, the effective operation of the control rod linkages 22 will be very long lasting, because the pivot joints 30, 32, 42, will adapt to accidental twisting of one of the link arms 24, 26 or 28 due to bending of the discharge spout 20 or discharge pipe extension parts under time-induced wear. Indeed, link arms 24–28 are originally exactly parallel to one another, but after a certain time in use, the snow chute 20 may become damaged under repeated impacts from hard materials collected with the snow during snow removal, and this damage to the snow chute may in turn tilt the link arms from the control rod linkages. With the present link arm joint, such tilting will not affect the relative pivotal motion capability of the link arms 24, 26, 28.

Figure 8:
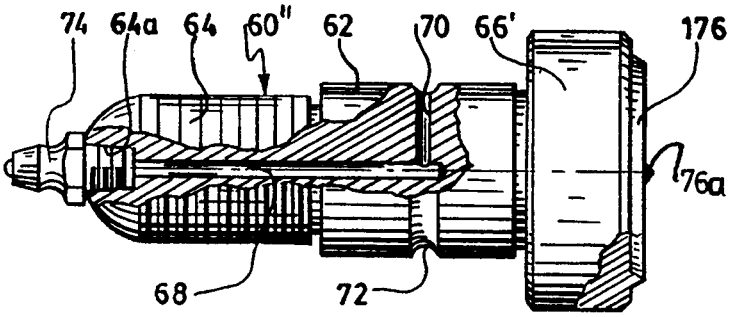
FIGS. 8 and 9 are a partly sectional plan view and an end view, respectively, of an alternate embodiment of the pivotal shank.
Figure 9:
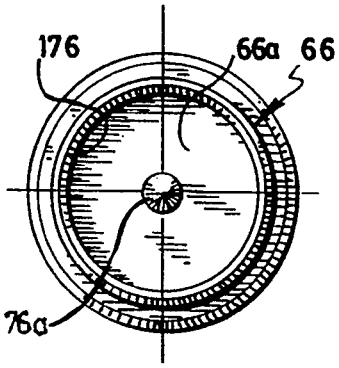

In the alternate embodiment of shank member illustrated as 60'' in FIGS. 8–9, the sharpened tip 76 at the central portion of the free face 66*a* of cylindrical part 66, is made bigger as shown at 76*a* and is associated with a sharpened ring 176 protruding from the peripheral section of the free circular face 66*a'* of head part 66'. Hence, beside making a central hole 40*b* into wall 40, as in the first embodiment of shank 60 at FIG. 6, an annular groove (not shown) is also made into surface 40*a* of wall 40 by knife ring 176. Such a double marking means 76*a*, 176, on shank 60'', is at least as efficient as the single tip of the first embodiment of shank 60. If desired only knife ring 176 can be used.

I claim:

1. In combination, a snow collecting and ejecting device for use as an attachment to automotive snowblower truck, said device defining:

(a) a box-like open casing, including upright opposite lateral side walls, a front snow engaging mouth between said side walls, and a top snow outlet port for escape of snow to be ejected from within said open casing;

(b) an elongated snow discharge spout pipe having an inner end secured to and in communication with said open casing said main spout pipe projecting outwardly from said open casing and having an outer end;

(c) telescopic spout pipe extension, pivotally carried by said outer end;

(d) control rod linkages, mounted to said spout pipe and commanding telescopic actuation of said spout pipe extension, said control rod linkages including first and second link arms, first pivot means for pivotally mounting said first link arm to said spout pipe, and second pivot means for pivotally interconnecting said first and second link arms to each other, each link arm having a collar at both ends, each collar defining a through bore and opposite parallel, flat, collar faces surrounding said through bore, each one of said first and second pivot means comprising:

a pivotal shank;

a ball and socket joint including a rigid spherical ball, having an axial through bore, said ball axial bore conforming with and being slidingly engaged by said shank;

a socket having a pair of complementary seating rings, each said seating ring defining a radially inner, segmental, spherical seating surface contacting said ball with an interface clearance, a smaller diameter cylindrical body fitted within said through bore and having a body inner face at its inner axial end and an out-turned shoulder at its outer axial end, said shoulder having a flat, annular, shoulder inner face parallel to said body inner face, the cylindrical bodies of each pair of seating rings inserted into said through bore through opposite ends thereof with said body faces in mutual contact and with said shoulder inner faces overlying the respective collar faces with a small clearance, securing means to secure said seating rings to said collar, the interface clearance between said ball and said socket allowing free relative rotatable movement of said ball within said socket but without play, said shank of each said first pivot means having one projecting end anchored to said casing side wall.

2. The combination defined in claim 1, wherein each one projecting end of said first pivot means shank further includes a sharp axial knife market tip, driven into one said casing side wall.

3. The combination defined in claim 2, wherein said ball axial bore and said shank are generally cylindrical, and further including lubricating means for said ball and socket including a fluid outlet port, opening at one end of said shank, an annular groove made at the outer peripheral surface of said shank into which opens said fluid outlet port, an annular groove at the outer surface of said ball and radial channels through said ball interconnecting the two grooves. outer peripheral surface defined by said shank into which opens said fluid outlet port, an annular groove at the outer surface of said ball and a radial channels interconnecting the two grooves.

4. A snowblower snow engaging casing as defined in claim 1, wherein each one projecting end of said first pivot means shank further includes a sharp, annular, knife member ring, driven into one said casing side wall.

* * * * *